US009631377B2

(12) United States Patent
Browne et al.

(10) Patent No.: US 9,631,377 B2
(45) Date of Patent: Apr. 25, 2017

(54) TAPERED EDGE DRYWALL CONNECTOR

(76) Inventors: Frank Michael Browne, Beaver Springs, PA (US); Kyle Edward Seward, Northumberland, PA (US)

( * ) Notice: Subject to any disclaimer, the term of this patent is extended or adjusted under 35 U.S.C. 154(b) by 2913 days.

(21) Appl. No.: 11/593,292

(22) Filed: Nov. 6, 2006

(65) Prior Publication Data

US 2007/0107348 A1 May 17, 2007

Related U.S. Application Data

(60) Provisional application No. 60/736,822, filed on Nov. 15, 2005.

(51) Int. Cl.
*E04F 19/06* (2006.01)

(52) U.S. Cl.
CPC ..... *E04F 19/062* (2013.01); *E04F 19/063* (2013.01)

(58) Field of Classification Search
USPC ..... 52/2.24, 35, 36.5, 254, 255, 257, 417, 52/420, 435, 459, 464, 466, 467, 468, 52/470, 478, 489.1
See application file for complete search history.

(56) References Cited

U.S. PATENT DOCUMENTS

| | | | | |
|---|---|---|---|---|
| 545,237 | A | 8/1895 | Lassam | |
| 2,073,278 | A | 3/1937 | Hohl | |
| 2,348,658 | A | 2/1941 | Slaughter | |
| 2,803,858 | A | 6/1955 | Rader | |
| 2,850,404 | A * | 9/1958 | Dunlap | 428/138 |
| 3,444,657 | A | 5/1969 | Swanson | |
| 3,675,383 | A | 7/1972 | Paoletti | |
| 4,020,611 | A * | 5/1977 | Amos | 52/586.1 |
| 4,157,271 | A * | 6/1979 | Moore | 156/71 |
| 4,237,669 | A | 12/1980 | Hunter | |
| 4,281,494 | A | 8/1981 | Weinar | |
| 4,467,578 | A | 8/1984 | Weinar | |
| 4,545,162 | A | 10/1985 | Attaway | |
| 4,553,363 | A | 11/1985 | Weinar | |
| 4,719,732 | A | 1/1988 | Bernard | |
| 4,913,576 | A | 4/1990 | Grant, Jr. | |
| 4,982,542 | A * | 1/1991 | Funaki | 52/770 |
| 5,045,374 | A | 9/1991 | Tucker | |
| 5,345,734 | A | 9/1994 | Tremblay | |
| 5,628,159 | A | 5/1997 | Younts | |
| 5,657,599 | A | 8/1997 | Peterson et al. | |
| 5,729,945 | A | 3/1998 | Memchetti et al. | |
| 6,018,924 | A | 2/2000 | Tamlyn | |
| 6,189,273 | B1 | 2/2001 | Larson | |
| 6,205,732 | B1 | 3/2001 | Rebman | |
| 6,230,469 | B1 * | 5/2001 | Santa Cruz et al. | 52/745.2 |
| 6,298,609 | B1 * | 10/2001 | Bifano et al. | 52/58 |

(Continued)

OTHER PUBLICATIONS

"Manufactured Housing Handbook" MH1216/REV8-98 US Gypsum Company 1998 Chicago IL.

(Continued)

*Primary Examiner* — Patrick Maestri
(74) *Attorney, Agent, or Firm* — Powell Law, PC; Mary H Powell

(57) ABSTRACT

A joint connector for connecting abutting edges of tapered drywall is provided that includes a base, a column projecting forward from said base, and mud legs extending generally perpendicular to said column forming pockets for receipt of tapered edges of said drywall.

20 Claims, 5 Drawing Sheets

(56) References Cited

U.S. PATENT DOCUMENTS

| | | | | |
|---|---|---|---|---|
| 6,684,586 | B1 | 2/2004 | Hoffman, Sr. | |
| 6,745,536 | B2 | 6/2004 | Tallman et al. | |
| 2006/0123730 | A1* | 6/2006 | Wambaugh et al. | 52/522 |
| 2008/0148660 | A1* | 6/2008 | Wambaugh et al. | 52/285.3 |

OTHER PUBLICATIONS

"Application and Finishing of Gypsum Panel Products" GA-216-2004 Gypsum Association 2004 Washington D.C.

* cited by examiner

TAPERED EDGE DRYWALL CONNECTOR

The present invention claims the benefit of U.S. Provisional Patent Application "Connector and System For Connecting Tapered Drywall To a Structure U.S. Ser. No. 60/736822" filed Nov 15, 2005.

FIELD OF THE INVENTION

The field of the present invention is that of connectors that juxtapose adjoining edges of tapered drywall.

BACKGROUND OF THE INVENTIONS

Methods of providing a continuous surface between the edges of tapered drywall can be found in a review of the documents "Manufactured Housing Handbook" by US Gypsum Company 1998, and "Application, and Finishing of Gypsum Panel Products" by Gypsum Association 2004.

SUMARY OF THE INVENTION

The present invention provides a revelation of an alternative apparatus and method of providing a flat continuous surface between the edges of tapered drywall to those apparatus and methods revealed previously.

DETAILED DESCRIPTION OF THE INVENTION

Figures 1A, 1B, 1C, 1D:
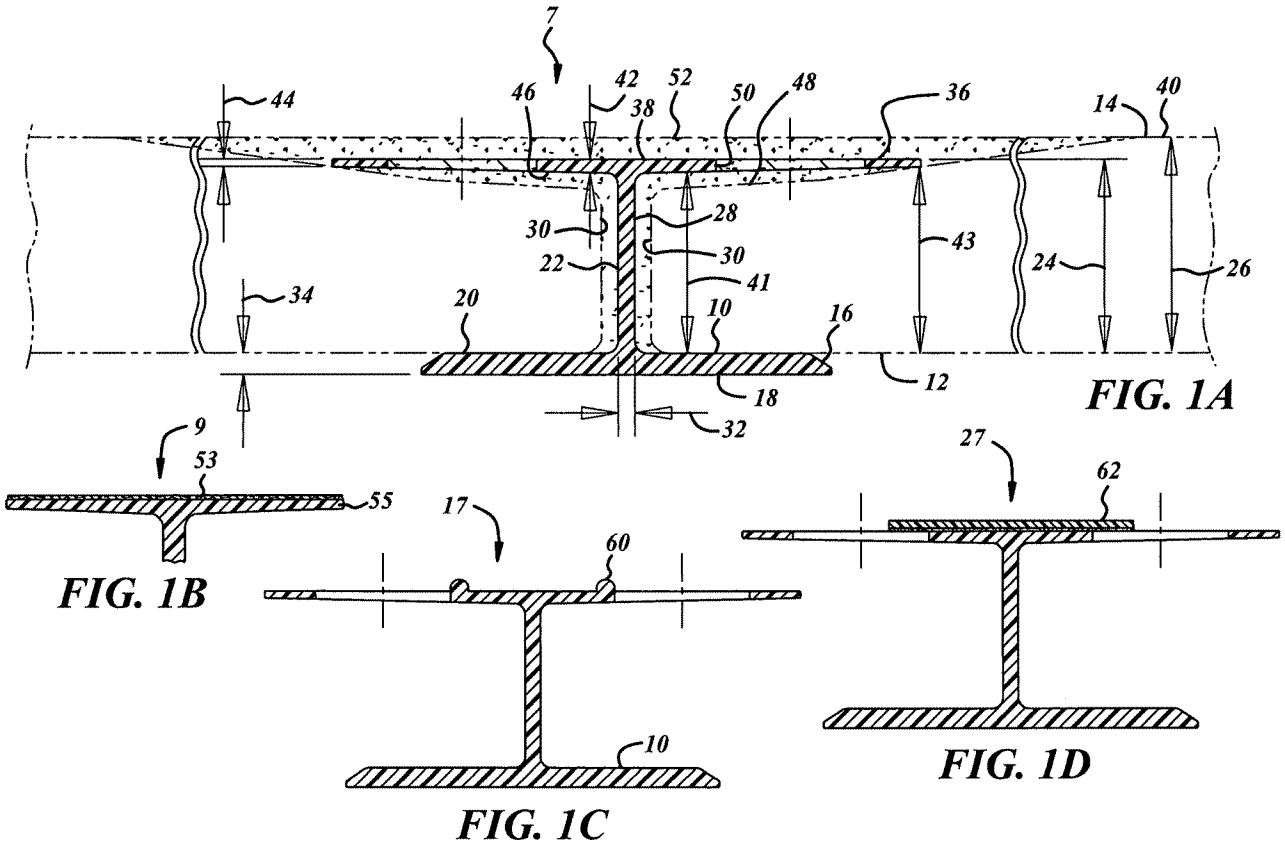
FIG. 1A is an enlarged sectional view of a preferred embodiment tapered edge drywall connector according to the present invention.
FIG. 1B is a partial sectional view of an alternate preferred embodiment tapered edge drywall connector according to the present invention.
FIGS. 1C and 1D are sectional views of alternate preferred embodiment tapered edge drywall connectors according to the present invention.
Figure 2:
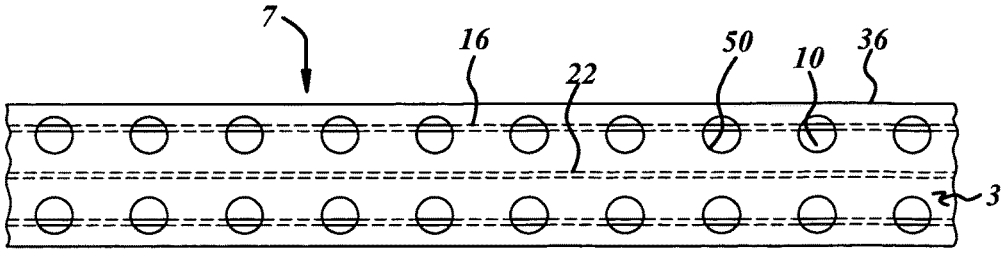
FIG. 2 is a top plan view of the tapered edge drywall connector shown in FIG. 1A.

Referring to FIGS. 1A and 2, crossectional and top plan views of a tapered edge drywall connector 7 of the present invention are shown. The term drywall as used in reference to the present invention also refers to sheet rock, gypsum board, wallboard or similar wall panels with tapered edges. The connector 7 can be fabricated from a metal such as aluminum or from a cellulosic material such as compressed cardboard. The connector 7 can also be made from a polymeric material such as a plastic. The plastic can be a rigid PVC material that optionally can be reinforced with a fiber material. The connector 7 can be an extrusion. It can be provided in lengths of 8 ft., 12 ft. and 14 ft., which are common drywall length dimensions or other customized lengths. The connector 7 can be used on horizontal or vertical orientation extending vertical wall drywall applications or on ceilings. The connector 7 is typically white or a shade thereof. In some applications, the connector 7 will be translucent to allow the edges of the drywall to be visible. The connector 7 can be dimensioned for more standard predefined thickness drywalls such as 5/16 in., ½in., ⅝in., ¾in. or other smaller or larger predefined thickness drywalls.

The connector 7 has a base 10. The base 10 has a tapered edge 16 to allow the drywall 14 to be loaded in from the side without excessive interference with an edge of a backing paper (not shown) of the drywall 14. The base 10 servers as a support for a rear surface 12 of the drywall 14. The base 10 usually extends along a major axis parallel or perpendicular to a structural member to which the drywall 14 is being connected. The structural member can be concrete, metal or a wood structural member that is often a 2×4 stud or joist. Some applications may have a metal support. Most stick built homes will utilize a 2×4 in. wooden stud or joist.

If the main axis of the support structure (not shown) is transverse to the base 10 and if it is desired that the rear surface 12 of the drywall be flush with the support structure, a small portion of the base 10 can be cut out to allow the support structure to be flush with the rear surface 12 of the drywall 14.

A front surface 20 of the base 10 can have a pre-applied layer of adhesive to help seal the rear surface 12 of the drywall. The adhesive on the base front surface 20 can be covered by a peal off strip. The base 10 can connect a support member with an adhesive that may be calked or sprayed. The base 10 can also be applied by the use of fasteners in a manner described hereinbelow.

Projecting forward from the base 10 in a generally perpendicular manner is a unitary integral column 22. The column 22 extends a distance 24 that is less than a thickness of the drywall 26 at its untapered portion (approximately 2-3inches from a lateral edge 30 of the drywall). The column sidewalls 28 are usually abutted by a generally forward projecting (or vertical as shown in FIG. 1A) portion 30 of lateral edges of the drywall 14 (a gap is shown between the sidewalls 28 and lateral edges 30 for purposes of illustration). In many applications, the column 22 has a thickness 32 that is typically slightly less than a thickness 34 of the base 10 to ensure the base 10 is less deformable than the column 22.

The column 22 has generally perpendicularly extending there from two mud legs 36. The mud legs 36, column 22, and base 10 form a pocket for receipt of the tapered edge drywall 14. The mud legs 36 have a generally flat front surface 38 that is lower (rearward) than a front surface 40 of an untapered portion of the drywall 14. When the connector 7 receives the tapered edges of the drywall, the length of the column 22 from the base 10 to the mud leg's surface 38 is less than the predefined untapered thickness of the drywall 14. The mud legs 36 have an inner thickness 42 generally adjacent the column 22 that tapers away from the base 10 to an outer thickness 44. The rear surface 46 of the mud legs is positioned in close proximity to a tapered portion 48 of the drywall lateral edge 30 and extends outwardly from the base 10 from a length 41 to a greater length 43. Preferably, the rear surface 46 is angled sufficiently to have a slightly increasing interference with the tapered portion 48 as the mud legs 36 extend outwardly from the column 22. Tapered portions 48 of abutting edges of the drywall 14 form a valley. The valley is filled with a plaster often referred to as joint compound or mud.

The mud legs 36 thickness 42 is typically significantly less than the thickness 34 of the base 10. Typical ranges are 14% to 40% less in thickness. Therefore, in most applications, deformation will occur in the mud legs 36 before it will occur in the base 10. The mud legs 36 typically will have a thickness 42 less than that of the column 22.

Prior to the present invention, a tape netting (joint tape) was applied over the abutting edges of the drywall. This tape was filled with the mud typically requiring three to four applications of mud until a front surface of the mud was flush with the adjoining front surfaces of the drywall concealing the "gap or joint" of the drywall assembly. The present invention connector 7 eliminates the need for the tape and additionally cuts back on the coats of mud needed to one or two.

The mud legs 36 have a series of apertures 50 to facilitate bonding with the mud 52. The mud leg front surface 38 can have knurls, grooves or other surface treatments to texture the same to facilitate mud adhesion. Additionally, a matting agent can be added to the mixture of the connector material to aid adhesion of the mud 52.

Referring to FIG. 1B, a connector 9 is essentially identical to connector 7 except that it has a pre-applied tape 53 on a front surface of the mud legs 55. The tape 53 has an increased adhesion with the mud 52 as compared with a remainder of the connector 9 and is typically fabricated from paper. The mud legs 55 can have apertures if so desired.

In mobile homes ceiling applications, the ceiling is often built by laying the drywall on the floor with the face (front) side down. The overhead roof framing structure is completed on top of the drywall and is glued thereto. The completed roof structure is then lifted into place on top of the parallel spaced walls of the home. To ensure the presence of a valley between the abutting edges of the drywall, a plate is placed down on the floor to push up the connector mud legs 36. The connector 17 of FIG. 1C has mud legs with bumps 60 to push up the base 10 outwardly. After the roof structure is applied to the drywall and before application of the mud, the bumps 60 can be shaved off. Connector 27 of FIG. 1D has a peel off tape 62 that performs the same function as the bumps 60. After the ceiling is positioned in its assembled final position, the tape 62 can be pulled off the mud legs to ensure a valley of sufficient depth.

Figure 6:
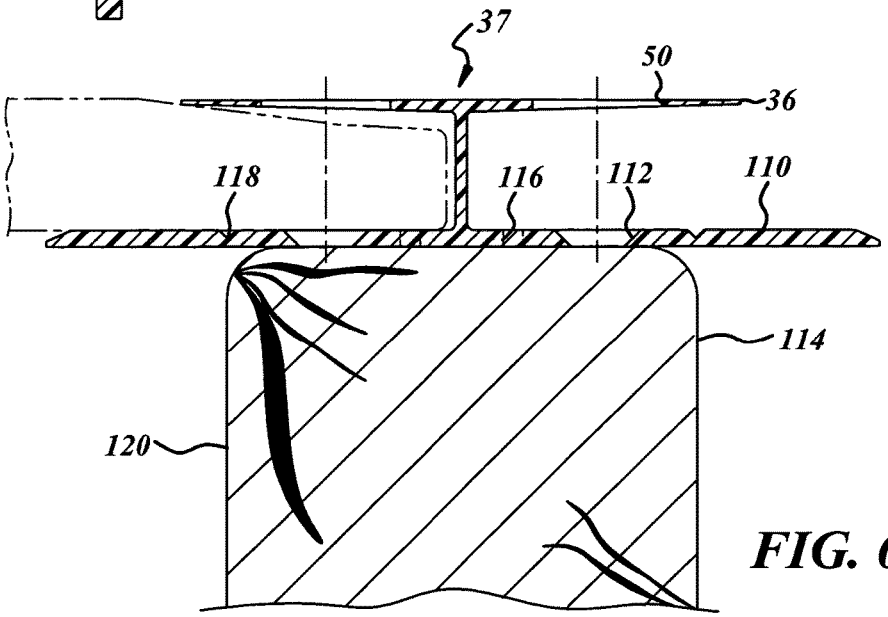

Connector 37 shown in FIG. 6 is substantially similar to connector 7 previously described. However, connector 37 has a base 110 having a series of chamfered apertures 112 to allow the base to be joined to a joist 114 by threaded fasteners (not shown). The aperture 112 can be a boring or an elongated slot. The apertures 112 are aligned with the apertures 50 to allow fastener installment with minimal interference with the mud legs 36.

The base 110 also has optional cure apertures 116 to increase contacting surface area of any adhesive and to aid in providing more atmospheric exposure for adhesive cure. The base 110 also has longitudinal grooves 118 to allow an extreme lateral edge of the base to be bent over for further attachment to a sidewall 120 of the joist 114 by fasteners or adhesives.

Figure 3A:
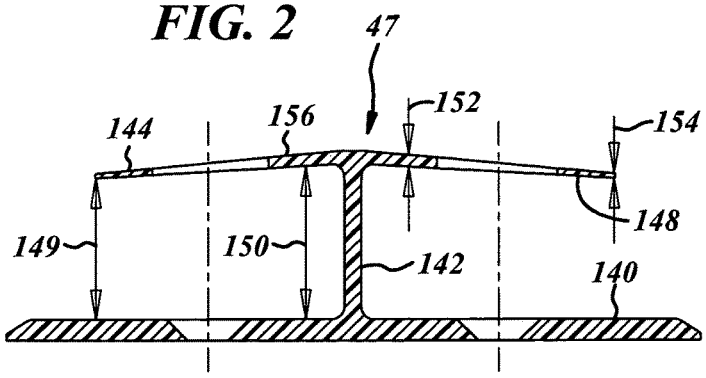
FIGS. 3A and 3B are partial sectional views of an alternate preferred embodiment tapered edge drywall connector according to the present invention.
Figure 3B:
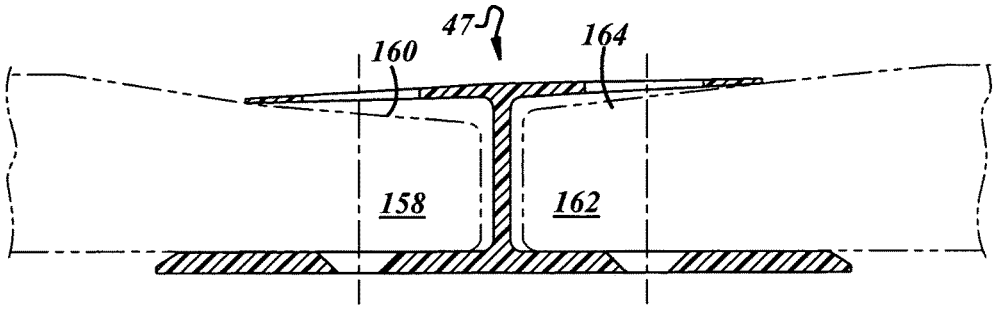
Figure 4:
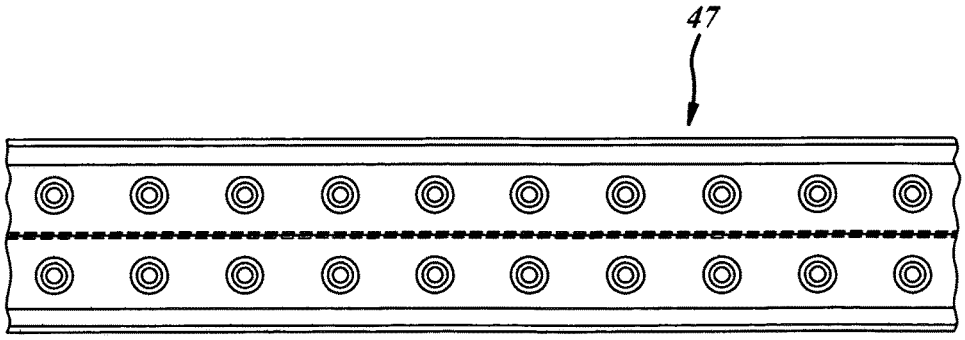
FIG. 4 is a top plan view of the tapered edge drywall connector shown in FIG. 3A.

FIGS. 3A, 3B, and 4 provide a connector 47 having a base 140 substantially similar or identical to base 110 of FIG. 6. Additionally, the column 142 is essentially the same as previously described column 22. The connector 47 has mud legs 144 having a rear surface 148 that tapers toward the base as it moves outward from the column 142 from a distance 150 to a shorter distance 149. The inner and outer thickness 152, 154 are comparable to prior described inner and outer thickness 42 and 44. The mud legs' combined front surfaces 156 meet together in a slight crown. Referring to FIG. 3B, the mud legs 144 are particularly useflil when drywall 158 has a low tapered portion 160 and the opposite drywall 162 has a high or regular tapered portion 164. A slight interference of the mud legs 144 with the drywalls 158 and 162 will increase in a direction away from the column 142.

Figure 5:
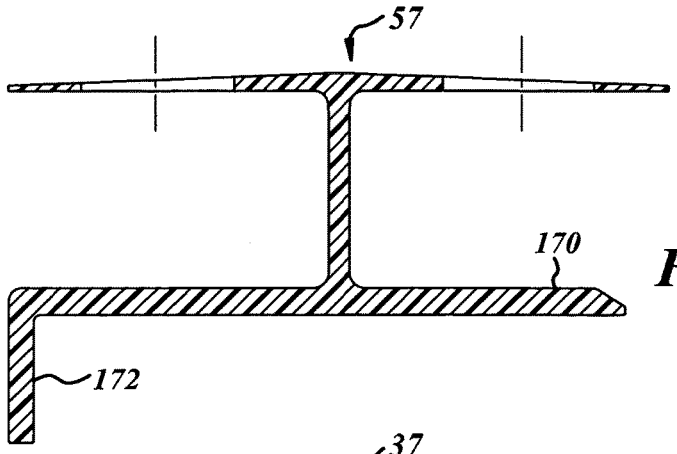
FIGS. 5-10 are partial sectional views of alternate preferred embodiment tapered edge drywall connectors according to the present invention.

Connector 57 of FIG. 5 is substantially similar to connector 47 with the main exception that it has a base 170 with a flange 172. The flange 172 serves the purpose of alignment of the base 170 with a support member so that the column 142 preferably projects along a centerline of a support member (not shown). The flange 172 is on only one side, therefore if the support member is positioned off center, the base 170 can still be moved from side to side.

Figure 7:
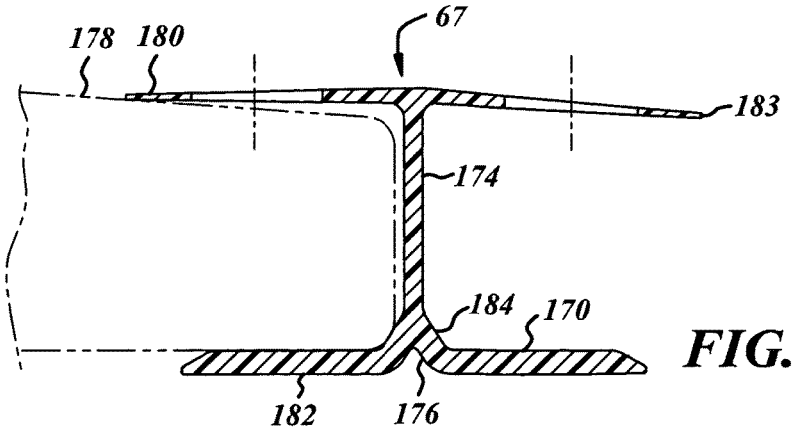

Connector 67 of FIG. 7 has a column 174 connected to a base 170 by a Y connection 176. Connector 67 is particularly useful when encountering drywall 178 that is oversized. The Y connection allows the mud leg 180, column 174 and base half 182 to accept the drywall 178 without causing the opposite mud leg 180 to excessively pivot its tip end 183 toward the base 170. Excessive pivotal movement of the tip end 183 causes difficulty installing the drywall sheet on the end of the connector 67 opposite the drywall 178. Undersized drywall is pushed up by the ramp surfaces 184 upon installation.

Figure 8:
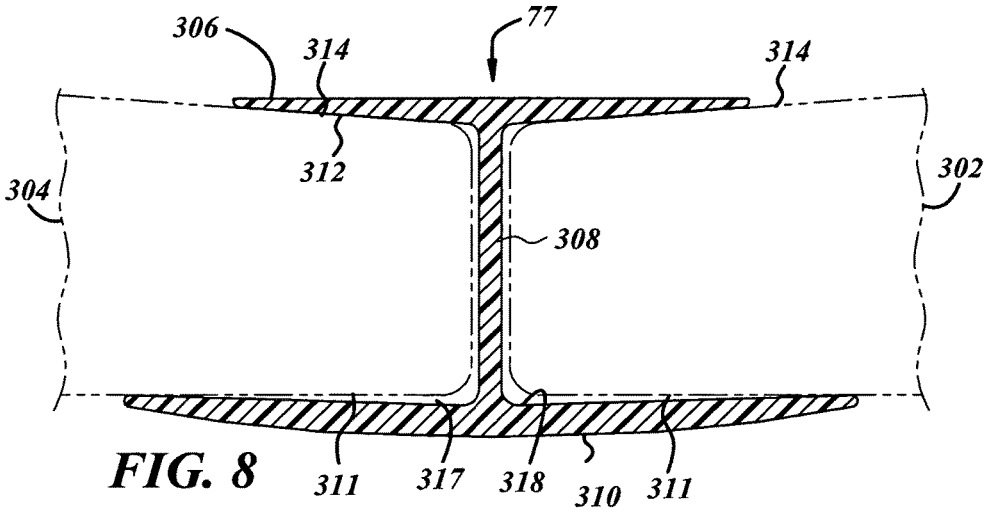

Referring to FIG. 8, a connector 77 is shown between drywall sheets 302 and 304. The connector 77 can have mud legs 306 essentially similar to mud legs 36. The connector 77 has a column 308 that can be longer in length than an untapered (maximum) thickness of the drywall sheets 302 or 304. The connector 77 has a base 310 that has a thickness significantly greater than a thickness of the mud legs 306. The base 310 is curved thereby giving it spring or compliant contact with a rear surface 311 of the drywall sheets 302 and 304. The spring force need not be strong enough to bend the drywall sheets 302 and 304 from their normal position. Typically adjacent the intersection of the column 308 with the base 310, there will be a slight gap 317 between the front surface of the base 318 and the drywall rear surface 311. The compliant contact pulls the column 308 rearward biasing the rear surface 312 of the mud legs 306 to be flush against the tapered portions 314 the drywall sheets 302 and 304.

Figure 9:
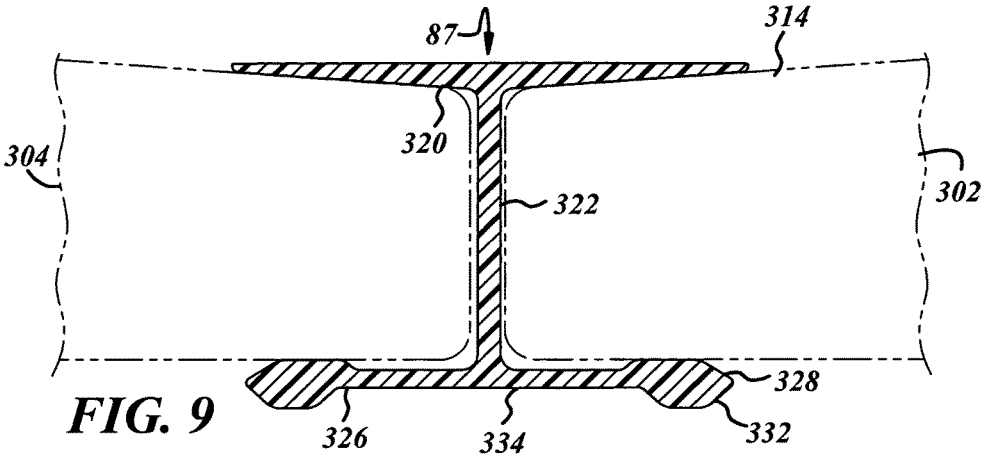

Connector 87 (FIG. 9) has mud legs 320 and a column 322 essentially similar or identical to the mud legs 306 and column 308 as previously described. Connector 87 has a base 326. The base 326 has positioning mounds 328 on a side adjacent the dry wall sheets 302 and 304. The positioning mounds 328 can be used to provide an increased spring force on the column 322 pulling it backwards.

The connector 87 optionally can have positioning mounds 332 on a surface adjacent a structural member (not shown). The positioning mounds 332 are provided to prevent contacts between a structural member and the base 328 in a region 334.

Figure 10:
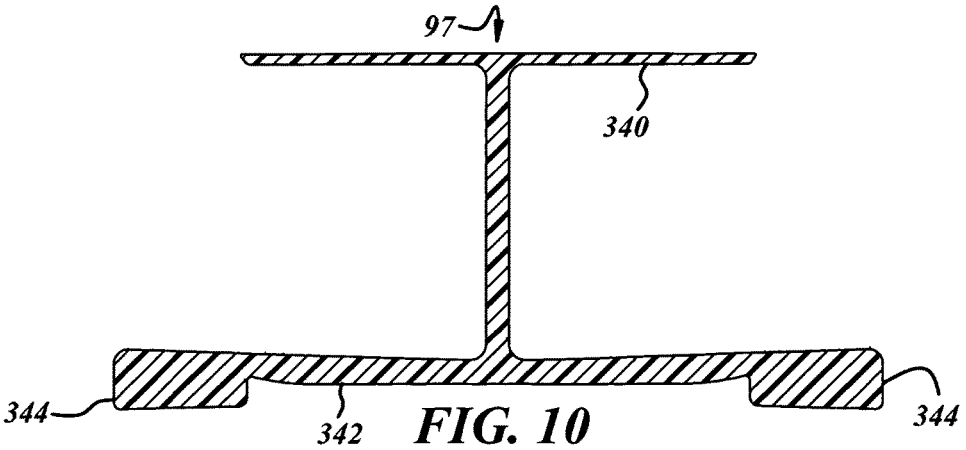

Connector 97 (FIG. 10) is similar to connectors 77 and 87 with the exception of constant thickness mud legs 340 and base 342 that has positioning mounds 344 on just a rear side of its base 342.

Figure 11:
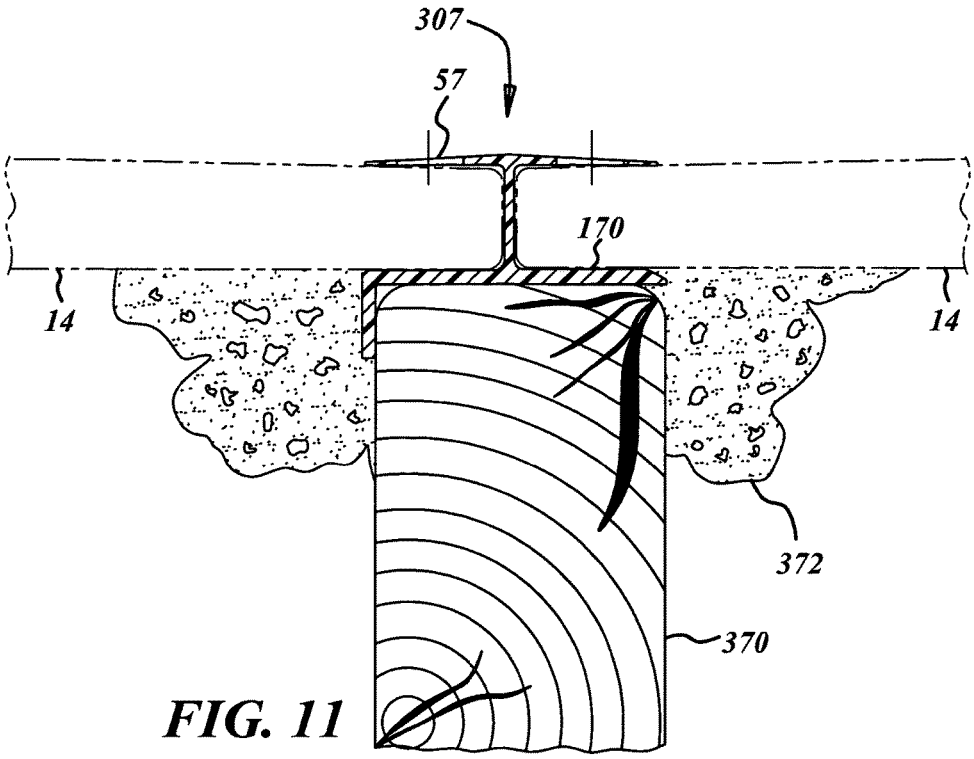
FIG. 11 is a sectional view of a construction assembly according to the present invention.

A construction assembly 307 using the connector 57 is shown in FIG. 11 upside down. Construction assembly 307 is particularly useful in mobile home ceiling applications. A structural member 370 extends generally parallel with the connector base 170. The abutting tapered edges of the drywall sheets 14 are installed within the pockets of the connector 57. The drywall sheets (and connector via the drywall sheets) are joined to the structural member 370 by lateral fillets of adhesive 372. The adhesive typically is a sprayed expandable foam type of adhesive such as a two-part urethane adhesive with 17% expansion when cured. The connector 57 aids in blocking the adhesive penetrating the gap between the drywall sheets 14.

Figure 12:
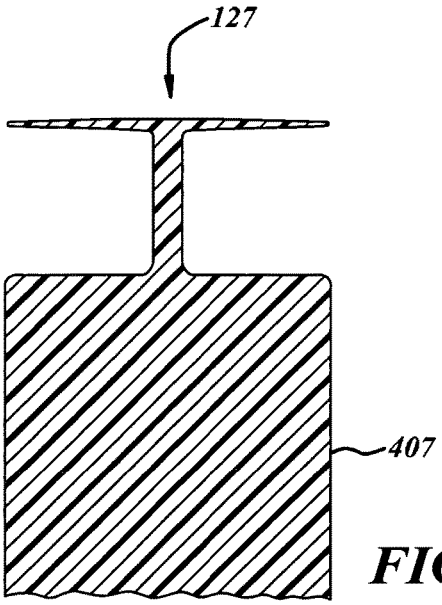
FIG. 12 is a structural member incorporating a connector according to the present invention.

FIG. 12 illustrates a composite or polymeric structural number 407 having an integral attached connector 127.

While preferred embodiments of the present invention have been disclosed, it is to be understood the present invention is described herein by way of example only, and various modifications can be made without departing from the spirit and scope of the invention as it is encompassed in the following claims.

We claim:

1. A joint connector for connecting in a flat continuous surface abutting edges of tapered drywall with a predefined untapered thickness comprising:

an extruded polymeric base;

a column integral with said base projecting forward from said base a distance less than an untapered thickness of said drywall; and mud legs extending generally perpendicular to said column forming with said base and said column pockets for receipt of edges of said drywall, said mud legs having a surface in slight interference with a tapered portion of said drywall edge and said mud legs having a thickness less than a thickness of said base:

whereby when the connector receives the tapered edges of the drywall, the length of the column from the base to the mud legs surface is less than said untapered thickness and whereby the connector is translucent.

2. A joint connector for connecting in a flat continuous surface abutting edges of tapered drywall comprising:

a base having compliant contact with a rear surface of said drywall that does not bend the drywall;

a column projecting forward from said base; and mud legs extending generally perpendicular to said column forming with said base and said column pockets for receipt of edges of said drywall, and whereby said base has a thickness greater than a thickness of said mud legs and when the connector receives the tapered edges of the drywall, said base has a spring force pull on said column to cause a surface of said mud legs to be biased into contact with a tapered portion of said drywall edge, and wherein the connector extends a length of the abutting edges of the tapered drywall and the connector is translucent.

3. A connector as described in claim 2 wherein at least one of the mud legs has a textured surface to facilitate a bond with joint compound.

4. A connector as described in claim 2 wherein at least one of the mud legs has an aperture to facilitate a bond with joint compound.

5. A connector as described in claim 2 wherein said base has a positioning mound on a side of said base adjacent said structure.

6. A connector as described in claim 2 wherein said base has a positioning mound on a side of said base adjacent said drywall.

7. A method of constructing a flat continuous surface drywall and supporting structure assembly comprising:

providing a joint connector including:

a base;

a column projecting forward from said base; and mud legs extending generally perpendicular to said column forming with said base and said column pockets for receipt of edges of said drywall, said mud legs having a surface in close proximity with a tapered portion of said drywall edges;

installing tapered edges of drywall into said pockets of said connector;

extending generally parallel to said connector adjacent said connector base a structural member; and joining said structural member with said sheets of drywall with lateral fillets of an expanding adhesive that when applied and cured connects the drywall and connector to the supporting structure and blocking the expanding adhesive from penetrating a gap between the edges of the drywall with said connector.

8. A joint connector for connecting in a flat continuous surface abutting edges of tapered drywall with a predefined untapered thickness comprising:

a base;

a column projecting forward from said base a distance less than an untapered thickness of said drywall;

mud legs extending generally perpendicular to said column forming with said base and said column pockets for receipt of edges of said drywall, said mud legs having a surface in close proximity with a tapered portion of said drywall edge; and whereby when the connector receives the tapered edges of the drywall, the length of the column from the base to the mud legs surface is less than said untapered thickness and wherein the connector is translucent.

9. A joint connector for connecting in a flat continuous surface abutting edges of tapered drywall with a predefined untapered thickness comprising:

a base with a tapered edge;

a column projecting forward from said base a distance less than an untapered thickness of said drywall;

mud legs extending generally perpendicular to said column forming with said base and said column pockets for receipt of edges of said drywall, said mud legs having a surface in close proximity with a tapered portion of said drywall edge; and whereby when the connector receives the tapered edges of the drywall, the length of the column from the base to the mud legs surface is less than said untapered thickness.

10. A joint connector for connecting in a flat continuous surface abutting lateral edges of tapered drywall with a predefined untapered thickness comprising:

a base;

a column projecting forward from said base a distance less than an untapered thickness of said drywall; and mud legs extending generally perpendicular to said column within a valley formed by tapered portions of said drywall, said mud legs forming with said base and said column pockets for receipt of said abutting edges of said drywall, said mud legs having a rear surface in close proximity with said tapered portion of said drywall edges, wherein said mud legs have a thickness 14-40% less than a thickness of said base and said mud legs having a front surface rearward of a front surface of an untapered portion of said drywall;

whereby when the connector receives the tapered edges of the drywall, the length of the column from the base to the mud legs surface is less than said untapered thickness and wherein the connector extends a length of said tapered drywall abutting edges and wherein the connector is fabricated from a material taken from a group including aluminum, cellulosic and polymeric materials.

11. A connector as described in claim 10 wherein said base can be connected with a building structure.

12. A connector as described in claim 10 wherein at least one of said mud legs has a slight interference with said tapered portion of said drywall edge.

13. A connector as described in claim 12 wherein interference of said mud leg with said tapered portion of said drywall edge increases in a direction away from said column.

14. A connector as described in claim 10 wherein at least one of the mud legs has a textured surface to facilitate a bond with joint compound.

15. A connector as described in claim 10 wherein said thickness of the mud legs decreases in a direction away from said column.

16. A connector as described in claim 10 wherein at least one of the mud legs has an aperture to facilitate a bond with joint compound.

17. A connector as described in claim 10 wherein the material said connector is made from has a matting agent added thereto.

18. A connector as described in claim 10 wherein said connector is made from a polymeric material.

19. A connector as described in claim 10 wherein said connector is made from a cellulosic material.

20. A connector as described in claim 10 wherein said connector is an extrusion.

* * * * *